US008745768B1

(12) United States Patent
Moghaddas

(10) Patent No.: US 8,745,768 B1
(45) Date of Patent: Jun. 10, 2014

(54) CONCEALED SMARTPHONE POCKET

(71) Applicant: Ahmad Moghaddas, Berkeley, CA (US)

(72) Inventor: Ahmad Moghaddas, Berkeley, CA (US)

( * ) Notice: Subject to any disclaimer, the term of this patent is extended or adjusted under 35 U.S.C. 154(b) by 0 days.

(21) Appl. No.: 14/202,258

(22) Filed: Mar. 10, 2014

Related U.S. Application Data

(62) Division of application No. 13/936,307, filed on Jul. 8, 2013, now Pat. No. 8,707,469.

(51) Int. Cl.
*A41D 27/20* (2006.01)

(52) U.S. Cl.
USPC ..... 2/247; 2/227

(58) Field of Classification Search
USPC ..... 2/247, 227, 294, 93, 228, 237, 254, 2/235, 79, 69
See application file for complete search history.

(56) References Cited

U.S. PATENT DOCUMENTS

| | | | | |
|---|---|---|---|---|
| 1,330,364 | A * | 2/1920 | Wine | 2/247 |
| 2,078,461 | A * | 4/1937 | Siegel | 2/93 |
| 2,593,795 | A * | 4/1952 | Rhoads et al. | 2/235 |
| 2,596,525 | A * | 5/1952 | Buelow | 2/227 |
| 2,778,026 | A * | 1/1957 | Rosenthal | 2/247 |
| 2,800,663 | A * | 7/1957 | Falk | 2/247 |
| 3,217,335 | A * | 11/1965 | Bell | 2/93 |
| 4,266,300 | A * | 5/1981 | Partridge | 2/247 |
| 4,791,681 | A | 12/1988 | Dean | |
| 5,054,127 | A | 10/1991 | Zevchak | |
| 6,233,747 | B1 | 5/2001 | Barker | |
| 6,253,379 | B1 * | 7/2001 | Collier | 2/108 |
| 6,311,335 | B1 * | 11/2001 | Uchida | 2/247 |
| 6,339,846 | B2 * | 1/2002 | Uchida | 2/247 |
| 7,681,255 | B2 | 3/2010 | Morales et al. | |
| 7,908,675 | B2 * | 3/2011 | Robinson | 2/247 |
| 7,926,123 | B2 * | 4/2011 | Walburg | 2/227 |
| 8,032,951 | B1 | 10/2011 | Nestberg et al. | |
| 2009/0282600 | A1 * | 11/2009 | Robinson | 2/79 |
| 2010/0050312 | A1 | 3/2010 | French et al. | |
| 2012/0185999 | A1 * | 7/2012 | Raviv | 2/247 |

* cited by examiner

*Primary Examiner* — Richale Quinn
(74) *Attorney, Agent, or Firm* — Goldstein Law Offices, P.C.

(57) ABSTRACT

A concealed safety pocket in a garment for securely carrying a smart phone and a method for making same. The safety pocket provides a separate storage place for carrying a smart phone where it can be found quickly, a user knowing exactly the place where the smart phone is. The smart phone is stored on a user's person and can be easily heard and answered, the safety pocket providing quick access to the smart phone. The separate safety pocket protects the smart phone from scratches from coins and keys. The safety pocket has a closure that prevents the smart phone from sliding out or falling out of a pocket, but providing quick access through the easily opened closure. The safety pocket attaches to a waistband and an open side seam, the closure of the pocket completing the side seam.

2 Claims, 4 Drawing Sheets

CONCEALED SMARTPHONE POCKET

CROSS-REFERENCE TO RELATED APPLICATIONS

This application is a divisional utility application of the nonprovisional utility patent application Ser. No. 13/936,307 filed in the United States Patent Office on Jul. 8, 2013 and claims the priority thereof and is expressly incorporated herein by reference in its entirety.

TECHNICAL FIELD

The present disclosure relates generally to a safety pocket. More particularly, the present disclosure relates to a concealed safety pocket in a garment for securely carrying a smart phone and method for making same.

BACKGROUND

Many people use smart phone or other electronic devices frequently throughout their waking hours. They take their devices everywhere they go. The devices not only are useful as phones but also store personal data of the owner. They want their phones to be easily accessible but they do not want to lose them.

Some people clip their smart phone to their belts, the phones easily accessible. However, it also means that they are easy to steal. Often the clips break and the device falls, suffering damage, loss or worse. Belt clips are not particularly secure.

Some users place their phone in their back or side pocket of their pants, shorts or skirt. However, they cannot access the phone when seated, especially when wearing a seatbelt. Sometimes the phone slides out of the pocket, suffering damage, loss or worse.

Others put their phones in a bag, purse, briefcase or the like. When the phone rings, they must rummage around to find it before the call ends. The phone is secure but not accessible.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a place for carrying a smart phone where it can be found quickly, a user knowing exactly the place where the smart phone is. Accordingly, an aspect of an example embodiment in the present disclosure provides a safety pocket in a garment, providing a separate storage place so that the smart phone can easily be found.

Another aspect of an example embodiment in the present disclosure is to provide a place for carrying a smart phone where it can be heard ringing, so that the phone is answered by the third ring. Accordingly, the present disclosure provides a safety pocket in a garment, so that a smart phone is stored on a user's person and can be easily heard and answered, the safety pocket providing quick access to the smart phone.

A further aspect of an example embodiment in the present disclosure is to provide a place for carrying a smart phone that protects the smart phone from scratches caused by rubbing against coins and keys. Accordingly, an aspect of an example embodiment in the present disclosure provides a safety pocket in a garment, providing a separate storage place protecting the smart phone from scratches from coins and keys.

Yet another aspect of an example embodiment in the present disclosure is to provide a place for securely carrying a smart phone without sliding out or falling out of a pocket. Accordingly, an aspect of an example embodiment in the present disclosure provides a safety pocket in a garment, having a closure that prevents the smart phone from sliding out or falling out of a pocket, but providing quick access through the easily opened closure.

The present disclosure describes a concealed safety pocket in a garment for securely carrying a smart phone and a method for making same. The safety pocket provides a separate storage place for carrying a smart phone where it can be found quickly, a user knowing exactly the place where the smart phone is. The smart phone is stored on a user's person and can be easily heard and answered, the safety pocket providing quick access to the smart phone. The separate safety pocket protects the smart phone from scratches from coins and keys. The safety pocket has a closure that prevents the smart phone from sliding out or falling out of a pocket, but providing quick access through the easily opened closure. The safety pocket attaches to a waistband and an open side seam, the closure of the pocket completing the side seam.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 3:
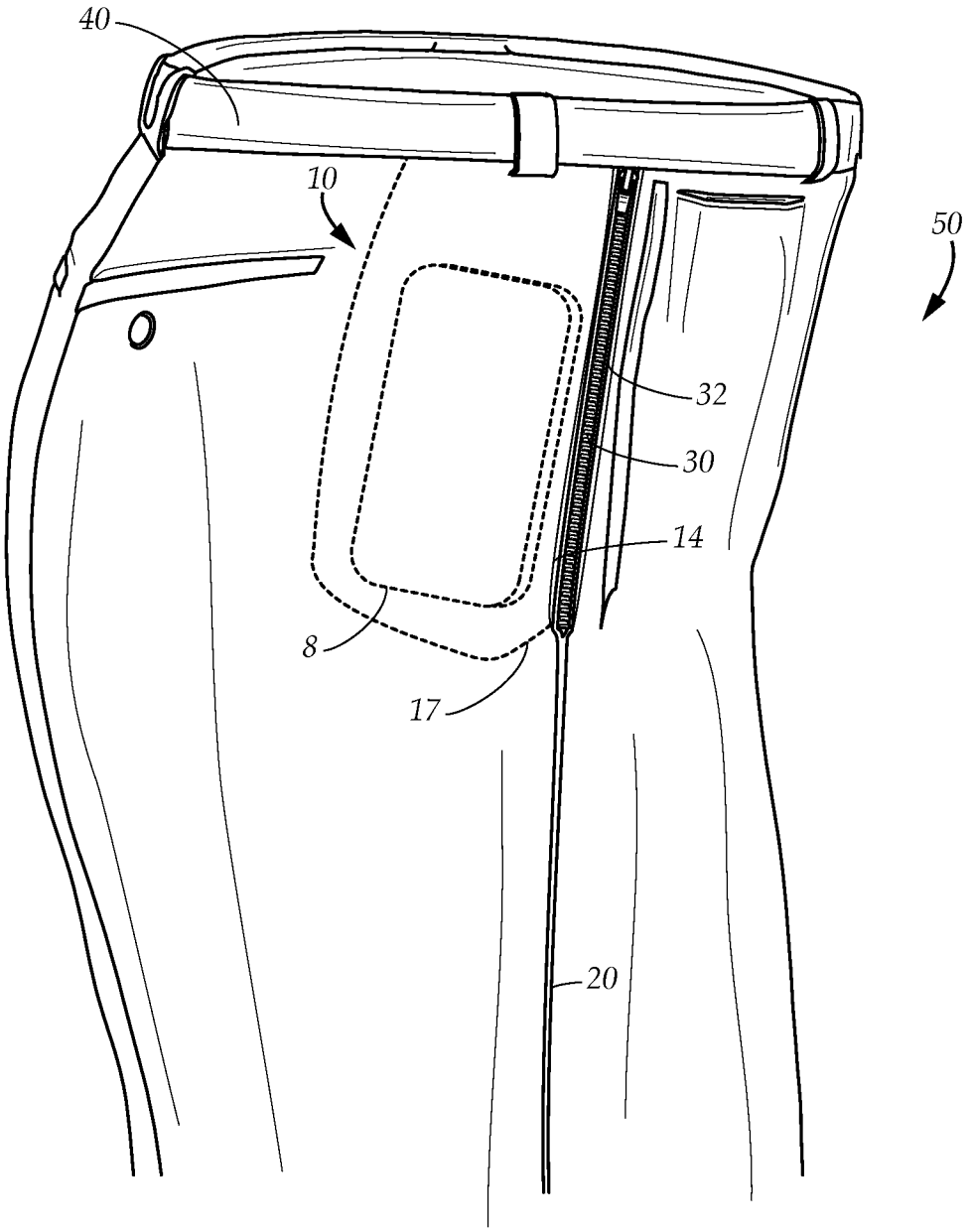
FIG. 3 is a perspective view of the side of the garment showing the concealed safety pocket in outline storing the smart phone also in outline.

FIG. 3 illustrates a garment 50 having a safety pocket 10 for securing a smart phone 8. The safety pocket 10 provides a separate storage place for carrying the smart phone where it can be found quickly, a user knowing exactly the place where the smart phone is. The safety pocket 10 has a closure 30 that prevents the smart phone from sliding out or falling out of a pocket, but providing quick access through the easily opened closure.

Figure 1:
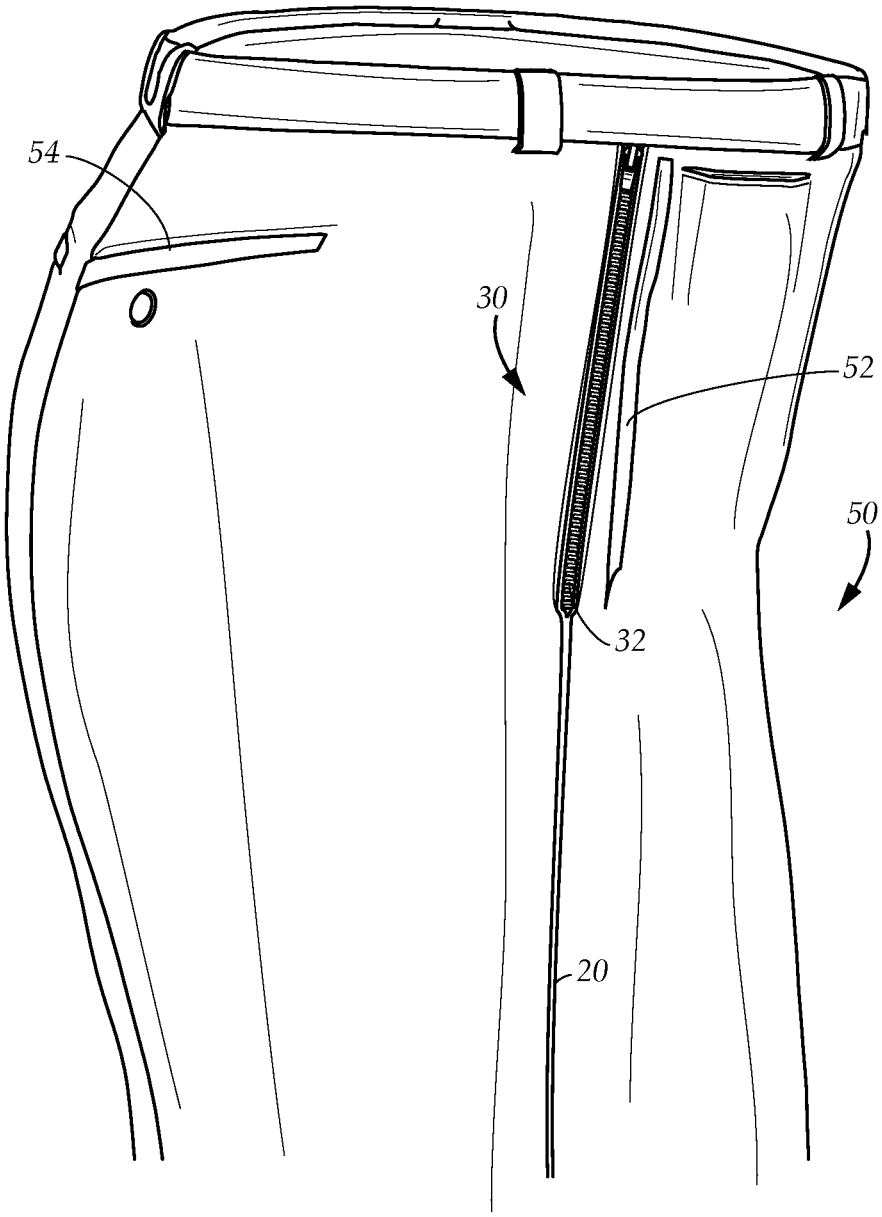
FIG. 1 is perspective view of a side of a garment with a concealed safety pocket for storing a smart phone.
Figure 1A:
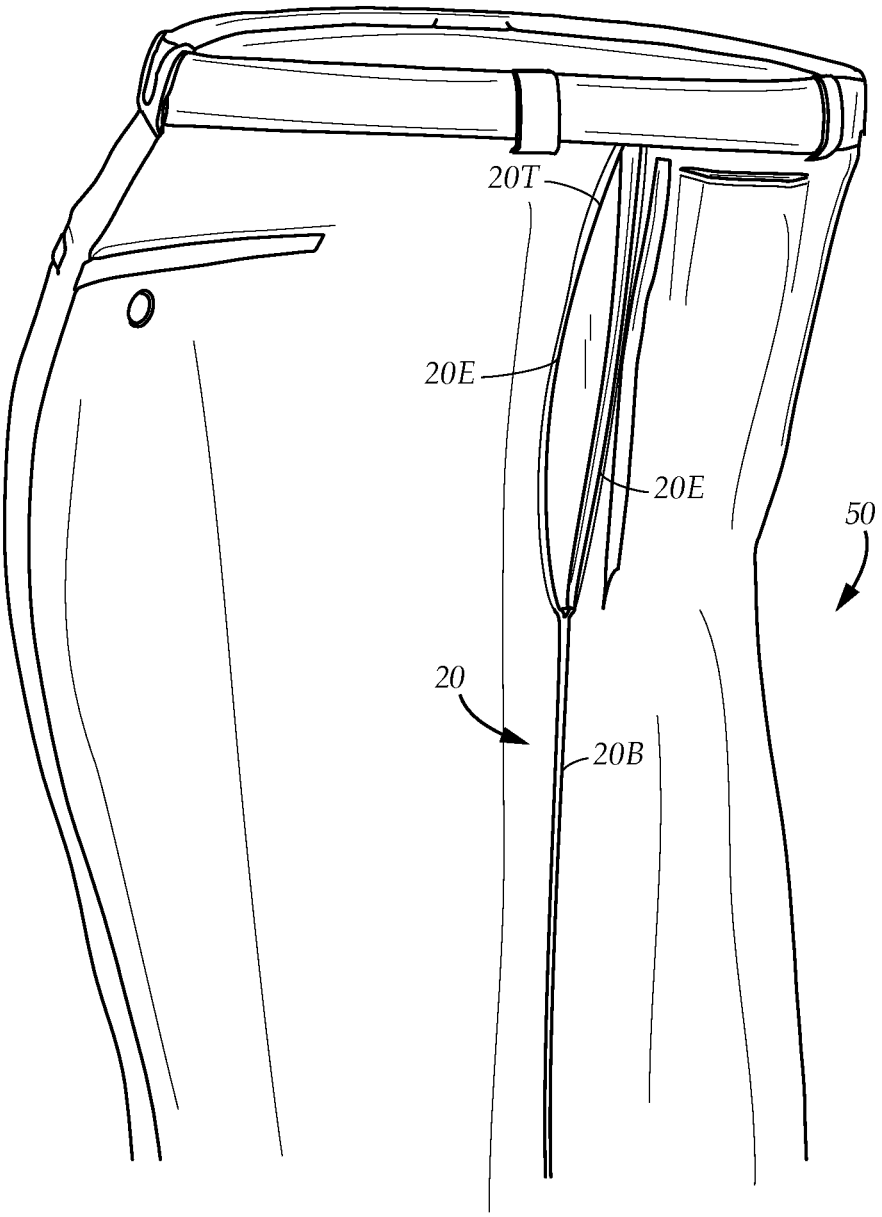
FIG. 1A is a perspective view of the side of the garment showing the incomplete side seam before the concealed safety pocket is attached.

As shown in FIG. 1A, the garment 50 has a waistband 40 and a partially incomplete side seam 20. The side seam has a complete bottom portion 20B and an incomplete top portion 20T. The top portion has a pair of edges 20E.

Referring again to FIG. 3, a closure 30 having a pair of tapes 32, said tapes 32 of the closure are joined to the incomplete top portion of the side seam 20, each tape of closure attaching to each edge of the incomplete top portion, one tape 32 to one edge. When the closure is closed, the edges of the incomplete top portion of the said side seam 20 are thereby closed.

In the illustration, the closure 30 is visible for easier access. It is understood by those of ordinary skill that the edges of the incomplete portion of the side seam can be further fashioned into a placket covering the closure when a more finished, tailored appearance of the garment is desired.

Figure 2:
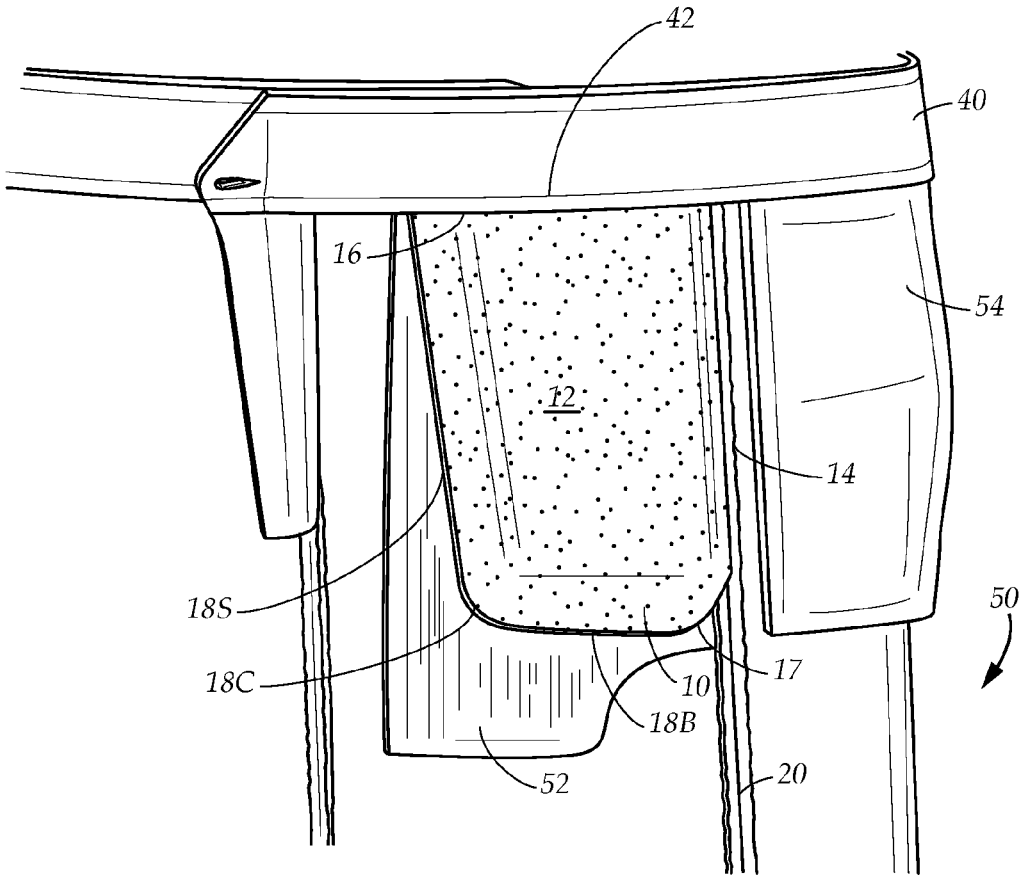
FIG. 2 is a perspective view of an inside of the garment having the concealed safety pocket for storing a smart phone.

Referring now to FIG. 2, a pair of substantially rectangular pocket walls 12 couple to the closure which is not shown in this illustration because the view is the inside of the garment 50. The pocket walls each have an open long side with an edge 14, the edge of the open long side attaching to the tape of the closure. The tapes of the closure, the edges of the top portion of the side seam and the edges of the pocket walls are all congruent, one tape couples to one edge of the side seam and to one long side of the pocket wall, either using one or two seams. The congruent edges and tapes of the closure form an opening for the pocket that is selectively opened and closed by opening and closing the closure.

The pocket walls each having a top side 16, the top sides of the said pocket walls attaching to the waistband 40, said pocket walls each having a long side 18S opposing the open long side, said long sides joining together, the walls each having a bottom side 18B opposing the top of the pocket wall, said bottom sides joining together, the joined long sides and joined bottom sides forming the safety pocket 10, the safety pocket securely holding the smart phone therein when the closure is selectively closed and providing easy access to the smart phone when the closure is selectively open.

The long sides 18S of the pocket walls 12 and said bottom sides 18B of the pocket walls are joined together by a continuous seam, the seam curving at the intersection 18C of said long sides and said bottom sides forming a rounded corner.

The open long sides 14 of the pocket 10 have a closed bottom portion 17, the bottom portion joining together by an angled seam connecting to the joined bottom sides, the angled seam slanting about 135 degrees as measured from the bottom seam 18B.

In one example embodiment, the top sides 16 of the pocket walls are about six inches wide and the long sides 18S of the pocket walls are about ten inches.

In one example embodiment, the closure is a zipper. In another example embodiment, the closure is a hook and loop fastener. The closure is preferably about six inches.

As shown in FIG. 2, the garment has a front, the waistband having a front portion extending from the side seam toward the front of the garment. The top sides of the pocket walls preferably attach to the front portion of the waistband for easy access. As shown in FIG. 3, the garment has a rear portion with a rear pocket and the waistband has a rear portion extending from the side seam toward the rear pocket of the garment. The top sides of the pocket walls attach to rear portion of the waistband if the wearer desires a flat appearance to the front of the garment.

It is understood by those of ordinary skill that the safety pocket 10 can be coupled to a right side seam or a left seam within the inventive concept.

As shown in FIG. 1A, a method of providing a safety pocket in a previously constructed garment 50 comprises partially disassembling the garment by disassembling the top portion 20T of the side seam 20 by removing the seam in the top portion thereby creating an opening having a pair of edges 20E.

Referring to FIG. 2, the waistband 40 has a bottom edge seam 42 and said waistband is partially disassembled by removing a portion of the bottom edge seam.

A closure 30, such as a zipper, the zipper having a pair of tapes 32 as shown in FIG. 1, is attached to the opening in the side seam, each tape of the zipper attaching to each edge of the open top portion of said side seam operative for joining the edges of the open top portion of said side seam thereby completing the seam.

Referring back to FIG. 2, the pair of substantially rectangular pocket walls 12 attach to the zipper, the pocket walls each having an open long side 14 with an edge, the edge of the open long side attaching to the tape of closure.

The pocket walls 12 are attached to the waistband 40 of the garment 50, the pocket walls each having a top side, seaming the top of the pocket walls together to the waistband 40 where the portion of the bottom edge seam 42 was removed during disassembly.

The pocket walls 12 are seamed together, forming the pocket 10, the walls each having a long side 18S opposing the open long side 14, said long sides joining together, the walls each having a bottom side 18B opposing the top of the pocket wall, said bottom sides joining together, said long sides and said bottom sides joining together by a continuous seam, the joined long sides and joined bottom sides forming the safety pocket, the seam curving at the intersection 18C forming a rounded corner, the safey pocket securely holding a smart phone therein when the closure is selectively closed and providing easy access to the smart phone when the closure is selectively open.

The open long sides 14 of the pocket 10 have a closed bottom portion 17, the bottom portion joining together by an angled seam connecting to the joined bottom sides, the angled seam slanting about 135 degrees as measured from the bottom seam. This angles tilts the smart phone carried therein towards the open long sides 14 and closure, making access to the phone easier.

The step of attaching the zipper tapes to the unjoined top portion of the side seam and the step of attaching a pair of substantially rectangular pocket walls to the closure can be performed at the same time.

The top sides 16 of the pocket walls are about six inches wide and the long sides 18S of the pocket walls are about ten inches, accommodating most smart phones. However, the pocket 10 can be adjusted by an additional temporary seam, commonly referred to a basting seam, the basting seam placed inwards from the seam joining the long sides and bottom sides, creating a smaller pocket so that the smaller device remains in an upright position for easy accessibility.

Still referring to FIG. 2, the method of providing a safety pocket 10 in a garment 50 during garment construction is similar to the method of retrofitting the safety pocket described hereinabove.

As shown in FIG. 1A, the side seam 20 of the garment 50 is partially finished, the top portion 20T of the side seam remaining temporarily incomplete and unjoined. The unfinished portion has a pair of edges 20E that temporarily are not seamed together. A closure, shown in FIG. 1, is attached to the unjoined top portion of the side seam, each tape of the closure attaching to each edge 20E of the incomplete top portion, joining the edges of the incomplete top portion of said seam thereby completing the seam.

Referring again to FIG. 2, a pair of substantially rectangular pocket walls 12 is attached to the closure, the edges of the open long sides 14 attaching to the tapes of closure.

The top sides 16 of the pocket walls 12 are attached to the waistband 40 of the garment, seaming the top of the pocket walls together to the waistband 40.

The walls 12 are seamed together forming the pocket 10, the long sides 18S joining together and the bottom sides 18B forming the safety pocket 10, the safety pocket securely holding a smart phone therein when the closure is selectively closed, providing easy access to the smart phone when the closure is selectively open.

In one embodiment, the long sides 18S and the bottom sides 18B are joined together by a continuous seam, the seam curving at the intersection 18C forming a rounded corner.

The open long sides of the pocket have a closed bottom portion 17, the bottom portion joining together by an angled seam connecting to the joined bottom sides 18B, the angled seam slanting about 135 degrees as measured from the bottom seam 18B.

In one embodiment, attaching the closure to the top portion of the side seam 20 and attaching the pocket walls 12 to the closure are performed at the same time in a single step.

In one embodiment, the garment 50 has the waistband having a front portion extending from the side seam 20 toward the front of the garment and has a front pocket 52 attached to the waistband 40. The safety pocket 10 is attached to the front portion of the waistband 40 behind the front pocket 52.

The garment of the present disclosure includes any garment having a waistband and a side seam, including as non-limiting examples, pants, shorts, a skirt. A dress having a waist seam attaching a bodice to the skirt is also possible within the inventive concept.

Throughout the present disclosure, the safety pocket is described as a device for securing smart phones. A smart phone is a non-limiting example to illustrate the uses for the safety pocket. It is understood that the safety pocket is not limited to smart phones but is useful for other handheld electronic devices such as personal digital assistants, mp3 players, cellphones and electronic gaming systems. The safety pocket is useful for other valuables as well.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a concealed safety pocket in a garment for securely carrying a smart phone and method for making same. The disclosure is illustrated by example in the drawing figures, and throughout the written description. It should be understood that numerous variations are possible, while adhering to the inventive concept. Such variations are contemplated as being a part of the present disclosure.

What is claimed is:

1. A garment having a safety pocket for securing a smart phone, comprising:

a waistband having a first waistband portion with a first pocket attached thereto;

a partially temporarily incomplete side seam, said side seam having a complete bottom portion, said side seam having an temporarily incomplete top portion adjacent to said waistband, said top portion having a pair of edges;

a closure having a pair of tapes, said tapes of the closure joined to the incomplete top portion of the side seam, each tape of the closure attaching to each edge of the incomplete top portion operative for joining the edges of the incomplete top portion of said seam thereby closing the seam;

a pair of substantially rectangular pocket walls coupled to the closure, said pocket walls each having an open long side with an edge, the edge of the open long side attaching to the tape of closure, said pocket walls each having a top side, the top sides of the said pocket walls attaching to the waistband behind the first pocket, said pocket walls each having a long side opposing the open long side, said long sides joining together, the walls each having a bottom side opposing the top of the pocket wall, said bottom sides joining together, the joined long sides and joined bottom sides finishing the safety pocket, the safety pocket concealed behind the first pocket, the safety pocket securely holding a smart phone therein when the closure is selectively closed and providing easy access to the smart phone when the closure is selectively open.

2. The garment as described in claim 1, wherein the open long sides of the safety pocket have a closed bottom portion, the bottom portion joining together by an obliquely angled seam connecting to the joined long sides, the angled seam operative for positioning a smart phone stored inside for easy retrieval, the smart phone maintained adjacent to the closure.

* * * * *